US009011280B2

(12) United States Patent
Gartland

(10) Patent No.: US 9,011,280 B2
(45) Date of Patent: Apr. 21, 2015

(54) SMALL DIAMETER DOUBLE CUTTER CROSSBOW BOLT

(71) Applicant: William Gartland, Youngstown, OH (US)

(72) Inventor: William Gartland, Youngstown, OH (US)

( * ) Notice: Subject to any disclaimer, the term of this patent is extended or adjusted under 35 U.S.C. 154(b) by 0 days.

(21) Appl. No.: 14/153,999

(22) Filed: Jan. 13, 2014

(65) Prior Publication Data

US 2014/0221138 A1 Aug. 7, 2014

Related U.S. Application Data

(60) Provisional application No. 61/751,635, filed on Jan. 11, 2013.

(51) Int. Cl.
*F42B 6/04* (2006.01)
*F42B 6/02* (2006.01)
*F42B 6/08* (2006.01)

(52) U.S. Cl.
CPC ... *F42B 6/02* (2013.01); *F42B 6/04* (2013.01); *F42B 6/08* (2013.01)

(58) Field of Classification Search
USPC ..... 473/578, 583, 585, 586
See application file for complete search history.

(56) References Cited

U.S. PATENT DOCUMENTS 4,254,958 A * 3/1981 Bateman, III ..... 473/583
4,874,180 A 10/1989 Fingerson et al.
4,905,397 A 3/1990 Juelg, Jr.
5,234,220 A 8/1993 Schellhammer et al.
5,417,439 A 5/1995 Bickel
5,846,147 A * 12/1998 Basik ..... 473/586
7,331,886 B2 * 2/2008 Morris et al. ..... 473/578
8,057,330 B2 11/2011 Blosser et al.
8,262,518 B2 9/2012 Palomaki et al.
8,388,473 B2 3/2013 Smith
8,460,134 B2 6/2013 Palomaki et al.
8,764,589 B1 * 7/2014 Thompson ..... 473/578

OTHER PUBLICATIONS

Browning Archery, 1990, pp. 24-27, Browning, Morgan, Utah, United States of America.

Browning 1992 Archery Products, 1992, pp. 24-27, Browning, Morgan, Utah, United States of America.

* cited by examiner

*Primary Examiner* — John Ricci
(74) *Attorney, Agent, or Firm* — Gary L. Eastman, Esq.

(57) ABSTRACT

The small diameter double cutter crossbow bolt of the present invention incorporates a midsection spacer having a plurality of blades, positioned mid-shaft of a small diameter shaft having a nock and a tip. The nock and midsection spacer has an outer diameter equal to the outer diameter of a standard bolt to ensure the centerline axis of the bolt is the same as a traditional crossbow bolt, allowing the use of the small diameter double cutter crossbow bolt in standard crossbow stocks and rails. In a preferred embodiment, midsection blade is formed with a lumen and is slid over the small diameter shaft. In an alternative preferred embodiment, the midsection spacer is a solid unit, joining two halves of a small diameter shaft. Thus, the small diameter double cutter crossbow bolt of the present invention provides a crossbow bolt capable of greater speeds, range, accuracy, kinetic energy, and lethality.

19 Claims, 4 Drawing Sheets

SMALL DIAMETER DOUBLE CUTTER CROSSBOW BOLT

CROSS REFERENCE TO RELATED APPLICATION

This application claims priority to and the benefit of the U.S. Provisional Application Ser. No. 61/751,635 for "Small Diameter Double Cutter Crossbow Bolt" filed on Jan. 11, 2013.

FIELD OF THE INVENTION

The present invention relates generally to archery and crossbows. The present invention is more particularly, though not exclusively, a small diameter crossbow bolt that features a midsection spacer fitted with an additional arrowhead, improving lethality while allowing use in place of a standard crossbow bolt, providing the flexibility to produce longer bolts with higher lethality, increased velocity, and kinetic energy.

BACKGROUND OF THE INVENTION

Historically the diameter of the crossbow bolt has been of a uniform construction, based upon the crossbow stock and rails from which it is fired. If a traditional bolt is not of a specific or even uniform diameter along its length, aiming the bolt is difficult and shots may become unpredictable; two characteristics to be avoided in a sport that emphasizes repeatability and predictability in aiming and accuracy. The crossbow stock and rails often determine the minimum/maximum diameter of a bolt, which must also be uniform in order to achieve a straight bolt flight path as it leaves the crossbow string.

Small diameter crossbow bolts have been developed to provide lighter weight bolts that travel faster and provide higher kinetic energy at impact with the target while remaining simple to manufacture, even providing the ability to retrofit traditional arrows for use in a crossbow.

The small diameter crossbow bolt includes a small diameter shaft having a leading end with an insert to receive a point. The trailing end of the shaft has a nock and adjacent fletching. The shaft is a small diameter fiber reinforced plastic (FRP) arrow having an outer diameter in the range of 0.220 to 0.245 inches, with a typical rating of 8.8 grains per inch.

The insert receives a point, such as a target point, broad head, or any other point known in the industry. A circumferential spacer is positioned along the shaft midway between the insert and the nock and moved along the shaft as needed to locate the spacer for a particular weight distribution, center of gravity, to accommodate various crossbow rail designs, or to separate the spacer from the nock.

The insert, spacer, and neck each have a diameter substantially equal to the diameter of a prior art bolt. When the diameters of the nock and spacer are the same as the diameter of a prior art bolt, the small diameter crossbow bolt is positioned such that the small diameter shaft sits horizontally above the rail, and thus can be used interchangeably with prior art bolts with no modification of the crossbow.

Small diameter crossbow bolts commonly travel at velocities far in excess of prior art bolts. This often results in the bolt completely penetrating the target animal, in the case of hunting.

In light of the above, notably the significantly higher velocity and kinetic energy, it would be advantageous to provide a crossbow bolt with a second arrow head, providing the shooter with another customizable element in bolt design, allowing for improved lethality of the bolt.

SUMMARY OF THE INVENTION

The present invention provides the crossbow user increased flexibility in crossbow bolt design. The small diameter bolt of the present invention incorporates a larger diameter nock and circumferential, midsection spacer, positioned mid-shaft, between the bolt tip and bolt tail. The nock and midsection spacer are of a diameter commensurate with the diameter of a standard bolt or at least compatible with the crossbow stock and rails. Together the nock and midsection spacer ensure the centerline axis of the bolt shaft remains in the same position it would be with a traditional crossbow bolt, despite the smaller diameter and lighter overall weight. The present invention thus provides lighter crossbow bolt shafts, capable of higher speeds and greater range, accuracy, and kinetic energy at impact with the target.

The higher velocity and the small diameter bolt often causes the entire bolt to completely penetrate the target, often travelling all the way through an animal. The present invention makes use of this phenomenon by employing a second set of blades on the midsection spacer or midsection arrowhead.

A preferred embodiment of the present invention incorporates a circumferential midsection spacer, formed as a collar, sliding over the small diameter shaft, allowing the use of a wide range of shafts and allowing manipulation of the center of gravity ("CG") and tuning of the forward of center ("FOC") balance.

Another preferred embodiment incorporates a second arrowhead formed in the midsection spacer, significantly increasing the lethality of a given crossbow bolt without compromising flight performance.

In an alternative preferred embodiment, the midsection spacer is a solid unit, joining two halves of a crossbow bolt. This embodiment further incorporates a second arrowhead with deployable or retractable blades. This embodiment further increases the stiffness of the bolt in joining the two shorter portions of the bolt shaft.

DESCRIPTION OF THE DRAWING

The objects, features, and advantages of the invention will be more clearly perceived from the following detailed description, when read in conjunction with the accompanying drawing, in which.

DETAILED DESCRIPTION

Figure 1:
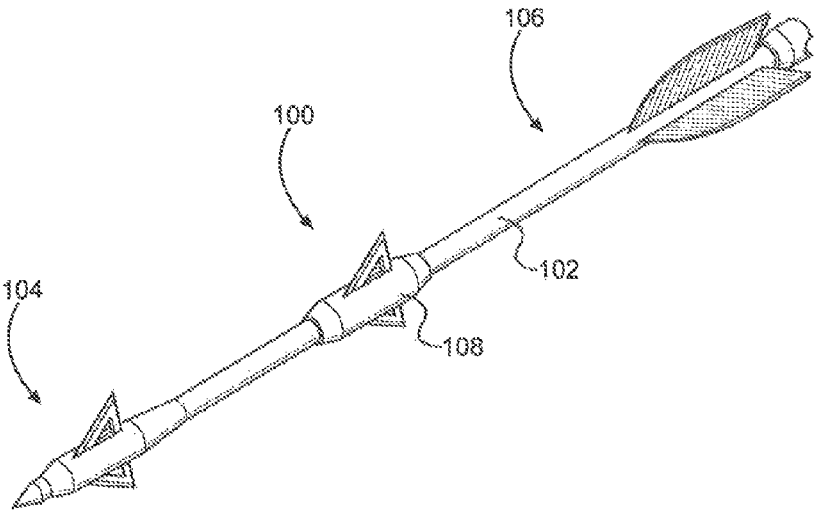
FIG. 1, is an isometric view of the small diameter double cutter crossbow bolt of the present invention, showing the arrowhead, midsection spacer with a second arrowhead, fletching and nock.

Referring to FIG. 1, the small diameter double cutter crossbow bolt of the present invention is shown and generally labeled 100. Bolt 100 has a shaft 102, a tip section generally labeled 104, a tail section generally labeled 106, and a midsection spacer 108.

Figure 2:
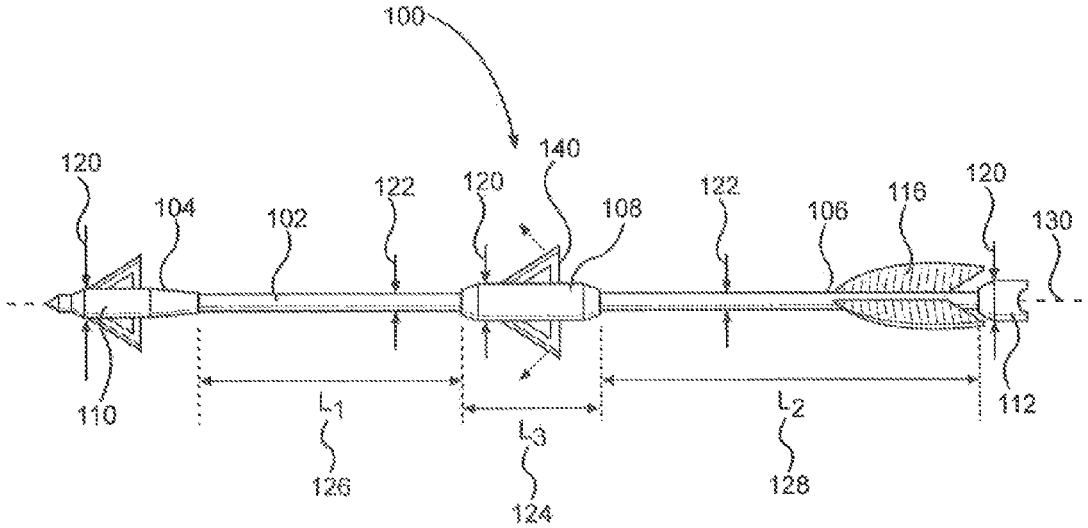
FIG. 2, is a diagrammatic side view of the small diameter double cutter crossbow bolt of FIG. 1, showing the arrowhead, midsection spacer with second arrowhead, fletching and nock, and depicting the relative diameters and lengths of each element of the Figure.

Referring now to FIG. 2, tip section 102 of bolt 100 has a tip 110 that can be selected from any of the standard arrowheads known in the art. Tip 110 is shown here as a broad head hunting arrowhead, having at least two blades. Tip 110 may just as easily be a target tip, as desired by the user. Tail section 106 has an enlarged nock 112 formed to accept the crossbow string (not shown) and fletching 116, commonly formed from three plastic or feather "vanes" that stabilize the bolt in flight.

Midsection spacer 108 has an outer diameter 120, while the shaft 102 has a small diameter 122, which is necessarily smaller than diameter 120. Midsection spacer 108 also has a length L3 (124) and is shown in this figure positioned a distance L1 (126) from the tip 110 and distance L2 (128) from the enlarged nock 112. Shaft axis 130 defines the centerline, or longitudinal axis of the bolt 100. When loaded on a crossbow and resting on midsection spacer 108 and enlarged nock 112, shaft axis 130 is parallel to the rails of the crossbow (not shown).

A prior art crossbow bolt (not shown) has uniform shaft construction, wherein diameter 120 would describe the exemplary diameter of the prior art shaft along the entire shaft axis. Variations from this construction would result in the bolt not sitting correctly within the rails from which it is fired. A common crossbow (not shown) makes use of such rails in a manner analogous to the barrel of a gun: to direct the flight of the bolt as the string accelerates the bolt and the bolt travels towards a target. If the bow string does not act on the shaft axis 130, the bolt does not fit the string, or the bolt does not lie properly within the rails, the bolt will not fire correctly, or travel on its intended path. This situation creates tremendous inaccuracies and a potential hazard to the shooter. A bolt that is too narrow for a given crossbow will not fire accurately.

The present invention makes use of a small diameter shaft 102 that by itself is not compatible with a crossbow. Therefore midsection spacer 108 is added to support the middle of the bolt 100 on the rails of a crossbow in the same manner as a prior art bolt. Nock 112 also has a diameter 120 in order to maintain the proper alignment of the bolt 100 on the rails of a crossbow and raise shaft axis 130 off the rails sufficiently to properly meet the crossbow string.

Midsection spacer 108 and enlarged nock 112 allow the use of shafts 102 with diameters not specifically designed for crossbows to be customized to fit a crossbow, such as the small diameter shaft 102 of the present invention. When fired, a standard bolt travels down the rails for the length of a crossbow stock, riding on the entire length of the shaft. Bolt 100 however, only rides on midsection spacer 108 and nock 112 when fired; not the entire length of shaft 102. The contact area of the midsection spacer 108 and the nock 112 with the crossbow rails represent approximately two percent (2%) of the length of the rails, significantly reducing the friction between the bolt 100 and the crossbow rails, increasing velocity.

The bolt 100 of the present invention is significantly lighter than traditional bolts allowing the shooter to use larger tips 110 or even longer small diameter shafts 102. The midsection spacer 108 also allows the bolt designer or user to move the CG toward the tip section 104 or aft toward the tail section 106 in order to fine tune the bolts 100 FOC balance. Adjusting for different tips 110, nocks 112, or fletching 116 has a dramatic effect on the flight characteristics of bolt 100.

In a preferred embodiment, the small diameter shaft 102 is employed to provide a longer bolt 100. Length L2 (128) in this case, can be the same as a standard crossbow bolt, making the bolt 100 roughly twice the length of a standard bolt and comparable to the length of an arrow fired from a traditional bow. In such an embodiment, the midsection spacer 108 is then in a position toward the end of the crossbow, where the tip 110 of a prior art crossbow bolt would lie.

In an embodiment, the tip 110, nock 112, and midsection spacer 108 are all balanced to provide an overall weight and FOC balance that does not overload the crossbow, yet takes advantage of the lighter and narrower shaft 102 in order to maximize range, accuracy, and kinetic energy at impact.

In a preferred embodiment, the midsection spacer 108 is further formed with blades 140 that provide improved lethality of the bolt 100. Often, the kinetic energy created by a crossbow firing a small diameter crossbow bolt such as bolt 100 is so significant that bolt 100 will completely penetrate a target, such as an animal, and travel completely through. The extra set of blades 140 on bolt 100 increases the bleeding of the animal and provide a faster and more humane death.

Upon impact, a traditional bolt tip 110 will penetrate the skin of a target animal and become lodged within the animal. Ideally, the impact will be with a vital organ resulting in a quick death for the target animal. The blades on a traditional broad head tip 110 are shaped to allow easy penetration at impact, but also such that the bolt will not fall out of the animal if it is not a kill shot. The size of the tip 110 also results in significant friction and transfer of kinetic energy (and slowing of the bolt) as the arrow penetrates the target. The bolt shaft also experiences similar friction upon impact with the target, depending on how deep the bolt penetrates.

The small diameter bolt 100 has been shown to fly much faster and penetrate deeper than a traditional bolt. The smaller diameter of the shaft 102 also results in lower friction allowing bolt 100 to travel completely through the target animal. Blades 140 provide not only improved lethality as the bolt moves through the target, but also increase the amount of friction the bolt 100 encounters at impact, transferring more kinetic energy to the target and slowing the bolt such that it does not travel completely through the animal.

Figure 3:
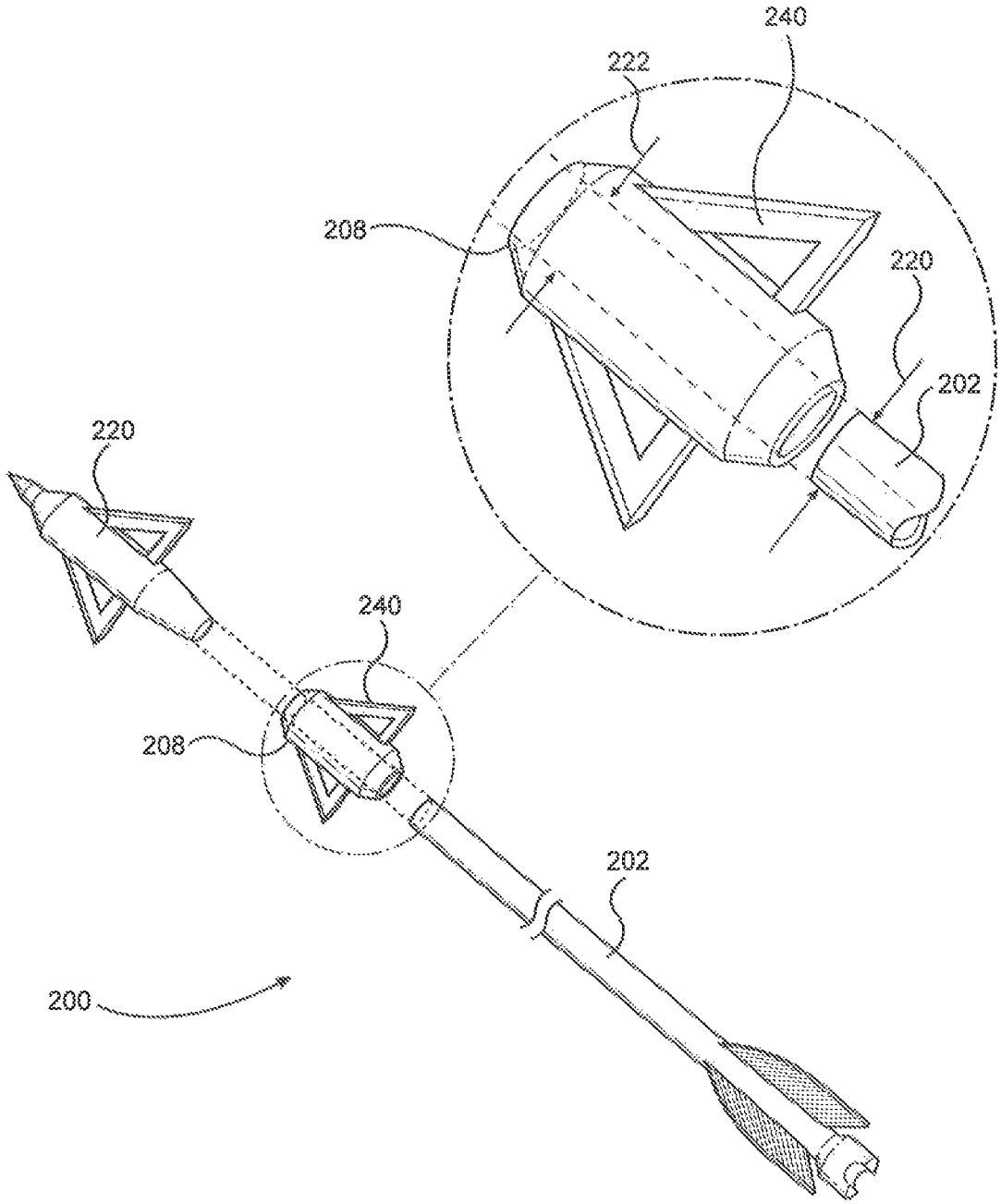
FIG. 3, is an exploded view of the small diameter double cutter crossbow bolt of the present invention, showing the midsection spacer, formed with a second arrowhead and constructed as a collar that slides over the outside of the small diameter crossbow bolt, also showing a close-up view of the midsection spacer and associated second arrowhead.

Referring now to FIG. 3, bolt 200 is shown in an exploded view, with the midsection spacer 208 formed as a collar, employed over a small diameter shaft 202. Shaft 202 can be a shaft specifically designed for crossbows or with different sized midsection spacers 208, giving the user the flexibility to utilize different arrow shafts as desired. The hollow, collar shape of the midsection spacer 208 can be placed in any position on the length of the shaft 202 and bonded in place by an adhesive such as epoxy. Weight, size, and composition of midsection spacer 208 can be modified allowing for different flight characteristics and FOC balance.

In a preferred embodiment, midsection spacer 208 is formed from a metal, such as aluminum, providing increased durability and low friction. It is to be appreciated by those skilled in the art that other materials providing decreased friction and durability may also be employed. Plastics such as polypropylene or delrin may be employed as well as lighter materials such as carbon fiber may also be used.

Midsection spacer 208 has an inner diameter 222 that is sized closely to accommodate the outer diameter 220 of shaft 202, such that there is a tight fitment. Shaft 202 is then inserted into the hollow center of midsection spacer 208. The midsection spacer 208 may then be slid along the length of shaft 202 to adjust for the desired location, and then affixed in place. Fixture of the midsection spacer 208 can be permanent using an adhesive such as epoxy or temporary using another type of fastener. Once spacer 208 is slid over the shaft 202, a bolt tip 210 can be attached as well.

The midsection spacer 208 is shown formed with a pair of blades 240 increasing the lethality of the bolt 200. Blades 240 can be formed into midsection spacer 208 in a pair, disposed on opposite sides of midsection spacer 208. Designs including three or more blades are also contemplated; however the number of blades 240 on midsection spacer 208 is limited by the rail design of the crossbow from which it is fired.

In an embodiment, the blades 240 may be retractable, and deploy after the bolt 200 is fired. In such an embodiment, the blades can be integrated in numbers greater than two. Given the hollow nature of the midsection spacer 208, there is less space to design blades 240 that are both retractable and the same size as those in a broad head tip 220. Thus, blades 240 that are intended to be retractable will generally be smaller than fixed blades for a hollow midsection spacer 208.

Figure 4:
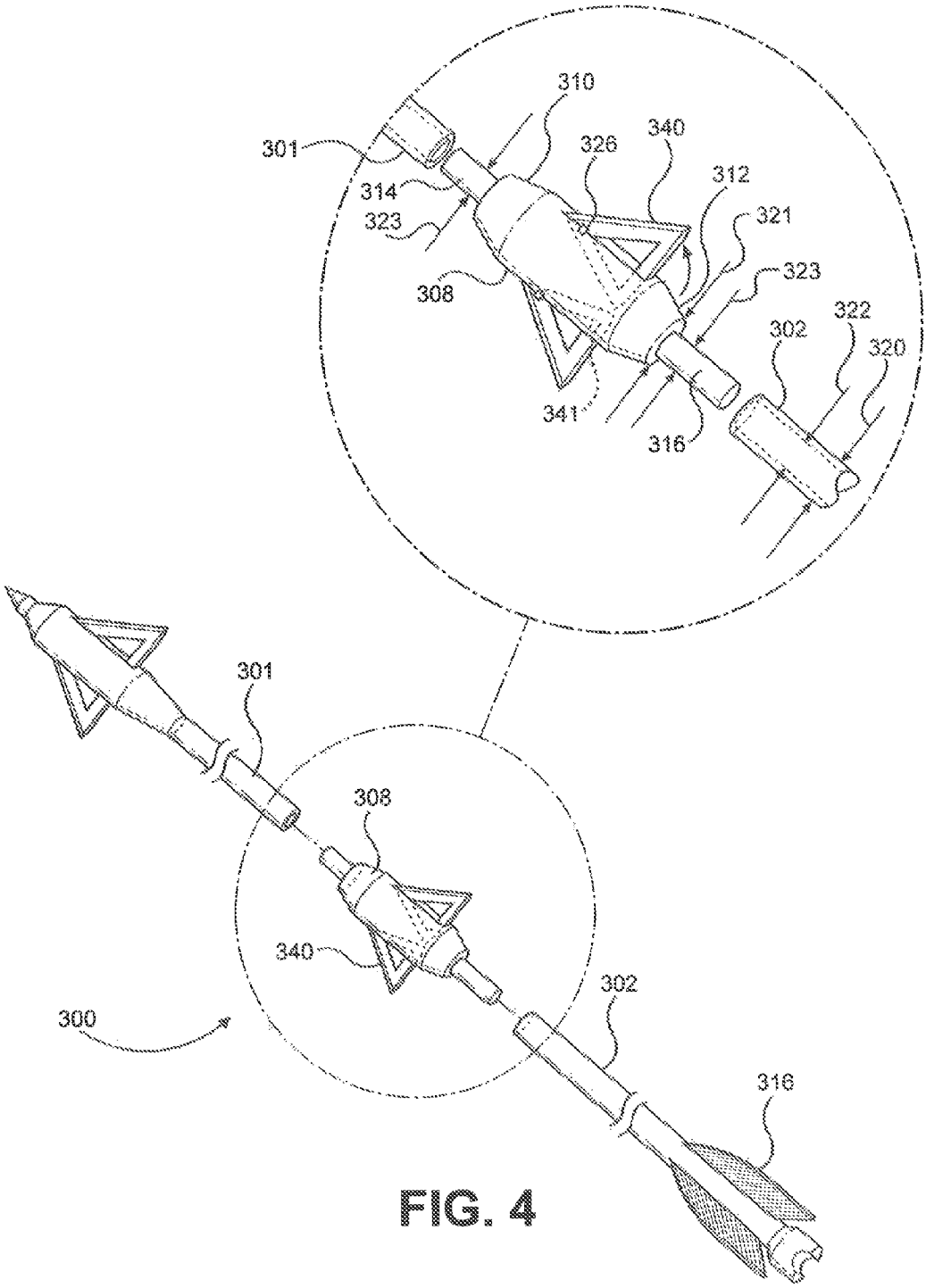
FIG. 4 is an exploded view of an alternative preferred embodiment showing the midsection spacer formed with a second arrowhead and constructed to accept a tip section and a tail section of the small diameter crossbow bolt.

Referring now to FIG. 4, an exploded view of an alternative preferred embodiment of the present invention is shown and generally labeled 300. Bolt 300 is shown with a midsection spacer 308, formed as a solid piece, joining two halves of a shaft, front section 301 and tail section 302. Generally speaking, a longer shaft will act more limber than a shorter shaft of the same construction due to the moment of the longer member exhibiting a greater static spine measurement. Accordingly, shorter shafts of front section 301 and tail section 302 "act" stiffer than a longer shaft 102 or 202 due to the shorter moment of the shorter shaft length. Further, midsection spacer 308 is formed of a metal such as aluminum or another solid material. Joining the three pieces—front section 301, midsection spacer 308, and tail section 302—then results in a bolt 300 that is stiffer but weighs the same as bolt 200 with the same accessories. Some variations in the overall weight are likely because a solid aluminum midsection spacer 308 will necessarily be heavier than a hollow midsection spacer 208 of the same material.

The solid construction of midsection spacer 308 also provides additional internal space for inclusion of retractable blades 340. Where blades 240 might be limited in number if they are formed to midsection spacer 208, more than two blades 340 may be built within midsection spacer 308 and deploy after bolt 300 is fired. Such an arrangement might be necessary to avoid interaction of the blades 240 or 340 with the rails of the crossbow during firing. Often crossbow rails incorporate a center channel through which one of the fletching 116 travels when bolt 100 is fired. Similarly, such a design accommodates more than two blades 140, 240, or 340.

In an embodiment, blades 340 are normally in a stowed position 341 (shown in dashed lines) prior to loading and firing bolt 300 from a crossbow. Blades 340 are spring loaded and extend after the bolt 300 is fired from the crossbow. In an alternative embodiment, the blades 340 are hinged at hinge points 326 within the midsection spacer 308 and extend as a result of the centrifugal force imparted by the rotation of the bolt in flight, induced by the fletching 316.

In a preferred embodiment, midsection spacer 308 is formed as a cylinder, tapered on each end to reduce drag on the bolt 300 in flight. Tapering of each end of the midsection spacer 308 is necessarily uniform around the circumference of shaft 302; however the taper of the leading end 310 of midsection spacer 308 need not be tapered in the same manner or degree as the trailing end 312 of midsection spacer 308.

In an alternative embodiment, the retractable blades 340 in midsection spacer 308 deploy upon impact with the target. Where the blades are fixed as is the case with blades 140 or 240, or where blades 340 deploy upon firing, they are extended during flight, increasing aerodynamic drag and reducing the velocity of the bolt 100 or 200. Where blade 340 are retractable and deploy at impact, blades 340 do not induce such drag decreasing the velocity of bolt 300. In such an embodiment, the sudden deceleration of bolt 300 caused by the impact with a target causes blades 340 to deploy providing increased lethality of the bolt. In an embodiment, deployment of the blades 340 is accomplished through an internal linkage (not shown) between tip 110 through the front section 301 that actuates the extension of blades 340. Alternatively, extension of the blades 340 can be accomplished using the momentum of the blades 340 acting to extend the blades upon the sudden deceleration of bolt 300 when the tip 110 impacts the target.

In an alternative embodiment, blades 340 detach from midsection spacer 308 upon penetration of the target. In such an embodiment, after the blades 340 are deployed, penetration of the target by the blades 340 creates increased friction on the midsection spacer 308. This friction causes the body of blades 340 to become detached from the midsection spacer 308, however the blades 340 remain connected to midsection spacer 308 by a short cable (not shown). This further increases the friction and lethality of the bolt 300 but help prevent the bolt 300 from penetrating completely through the target.

Because bolt 300 straightness is an important concern, the leading end 310 and trailing end 312 of midsection spacer 308 each have concentric pins 314 and 316, respectively ensuring bolt straightness. The front section 301 and tail section 302 both have an outer diameter 320 and a central lumen with an inner diameter 322. Concentric pins 314 and 316 have an outer diameter 323 slightly smaller than inner diameter 322 providing a secure fitment when connected together. At the narrowest point, midsection spacer 308 further has a taper diameter 321 that is sized to closely match the outer diameter 320 of both front section 301 and tail section 302, allowing the use of various sized small diameter bolt shafts sections 301 and 302. The interaction of the concentric pin 314 with the lumen of front section 301 and the interaction between the concentric pin 316 and the lumen of tail section 302 ensure a secure fit and a straight connection. The dimensions of concentric pins 314 and 316 and precise fitment with inner diameter 322 of front section 301 and tail section 302 serve to ensure bolt 300 straightness, despite being constructed of multiple pieces.

Figure 5:
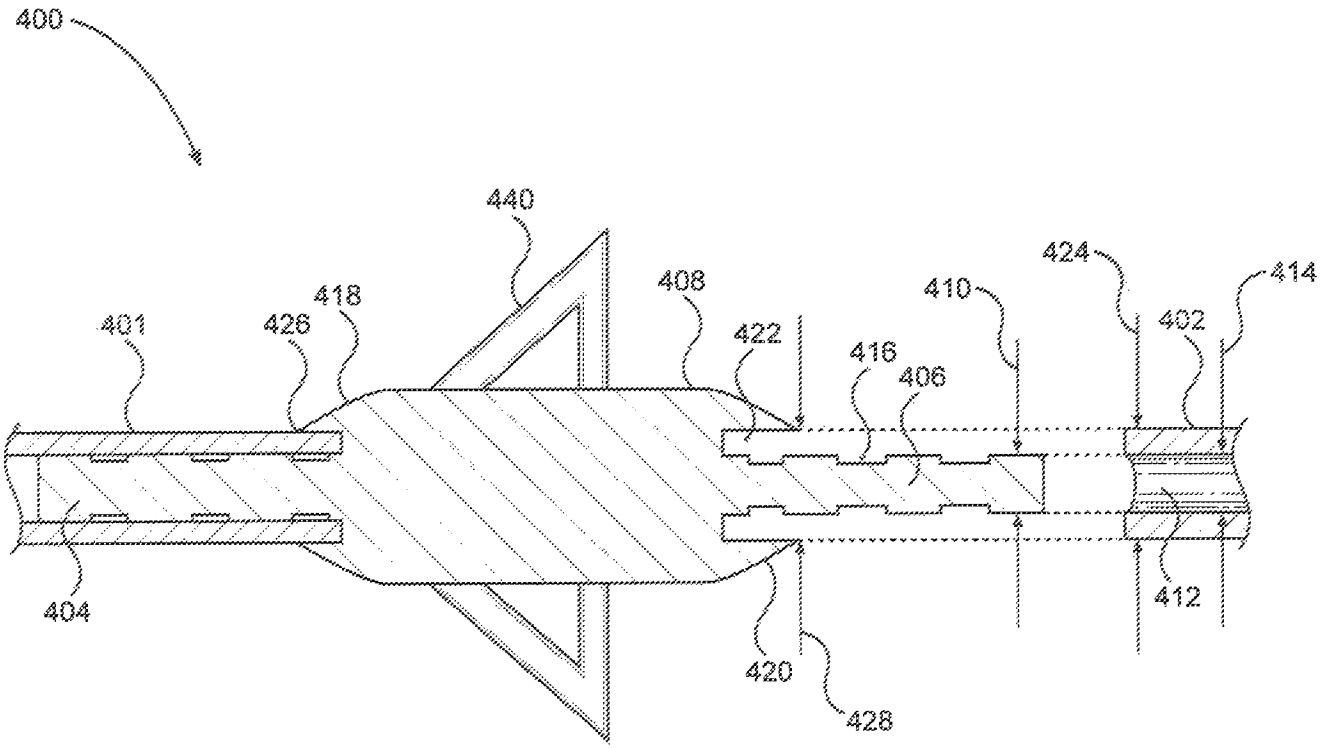
FIG. 5 is a cross sectional view of the alternative preferred embodiment of FIG. 4, showing the interaction of the front section and tail section of the crossbow bolt shaft with the leading taper, trailing taper, and elongated pins on the leading and trailing edges of the midsection spacer, in addition to the relative diameters of each component.

Referring finally to FIG. 5, a portion of the cross section of an alternative preferred embodiment of small diameter double cutter crossbow bolt of FIG. 4 is shown and generally labeled 400.

Small diameter bolt 400 employs a midsection spacer 408 in much the same way as midsection spacer 300, joining a front section 401 and a tail section 402 each formed of a portion of a small diameter crossbow bolt shaft 102. Midsection spacer 408 is fitted with blades 440 that may incorporate the previous described characteristics of other embodiments. Midsection spacer 408 further employs a leading pin 404 and a trailing pin 406 with identical diameters 410. Tail section 402 has a central lumen 412 with an inner diameter 414 sized to accept trailing pin 406. Likewise front section 401 has an identical central lumen 412 with an inner diameter 414 sized to accept leading pin 404. The leading pin 404 and the trailing pin 406 and sections 401 and 402 are intended to be affixed to one another through the use of an adhesive. In a preferred embodiment, each leading pin 404 and trailing pin 406 can be formed with circumferential cavities 416 having outer diameters smaller than diameter 410 providing a space to accommodate of such an adhesive and increase adhesion.

Referring briefly back to FIG. 4, midsection spacer 308 only incorporates concentric pins 314 and 316 to ensure bolt 300 straightness. In the event the diameter 321 of midsection spacer 308 does not exactly match the outer diameter 320 of shaft 302, a ridge between the two components will be present, adversely affecting the bolt's 300 aerodynamic properties.

FIG. 5 shows a preferred embodiment in which midsection spacer 408 further includes a leading flange 418 and a trailing flange 420 that overlap a portion of front section 401 and tail section 402 when connected, further ensuring bolt 400 straightness. This overlap creates an annular ring 422 on both ends of midsection spacer 408 into which each section 401 and 402 are securely fit.

FIG. 5 depicts tail section 402 disconnected from the trailing pin 406 of midsection spacer 408, with dashed lines indicating where the two parts fit together. Annular ring 422 belying trailing flange 420 is sized to securely accept the end of tail section 402 having an outer diameter 424. In an embodiment, an adhesive may be applied to the circumferential cavities 416 before trailing pin 406 is inserted into the lumen 412 of the tail section 402. When fit together, trailing flange 420 will lie over a portion of the outside of tail section 402. In the same manner, front section 401 is shown with leading pin 404 fit within the central lumen 412 of front section 401, and leading flange 418 overlapping a portion of the front section 401.

As shown, leading flange 418 is tapered to a point 426 where it meets the outer surface of front section 401, while trailing flange 420 is tapered in a similar manner, meeting the outer surface of tail section 402. A minimum taper diameter 428 is then created on the outer surface of midsection spacer 408. Such a manner of tapering the leading flange 418 and trailing flange 420 guarantees a smooth transition along the outer surface of bolt 400 and minimizes any aerodynamic drag. Without such a taper, a ridge would be formed where midsection spacer meets front section 401 and tail section 402 that may negatively impact bolt 400 performance. In a preferred embodiment, the minimum taper diameter 428 is nearly identical to outer diameter 424 of front section 401 and tail section 402 providing the smoothest possible transition along the outer surface of bolt 400.

In an embodiment, the angle and length of the leading flange 418 and trailing flange 420 may be manipulated in order to provide desired aerodynamic characteristics. The degree and length of such tapering need not be identical between the two surfaces.

What is claimed is:

1. A small diameter double cutter crossbow bolt comprising:

an elongated shaft formed with a lumen and having a central axis, a front end, a tail end, and an outer surface having a first diameter;

a spacer, formed as a collar having an outer diameter and a cylindrical axial bore with an inner diameter greater than said first diameter of said elongated shaft, and slidable along said outer surface of said elongated shaft, wherein said spacer further comprises a leading taper and a trailing taper; and a plurality of blades extending axially from said spacer.

2. The small diameter double cutter crossbow bolt of claim 1, wherein said leading taper of said spacer is symmetrical to said trailing taper of said spacer.

3. The small diameter double cutter crossbow bolt of claim 1, wherein said plurality of blades is equally spaced apart and fixedly attached to said spacer.

4. The small diameter double cutter crossbow bolt of claim 1, wherein said plurality of blades is equally spaced apart and hingedly attached to said spacer.

5. The small diameter double cutter crossbow bolt of claim 1, wherein said plurality of blades is equally spaced apart and configured to be retractable.

6. The small diameter double cutter crossbow bolt of claim 1, further comprising an adhesive applied between said outer surface of said elongated shaft and said inner diameter of said spacer to secure said spacer at a desired location on said elongated shaft.

7. The small diameter double cutter crossbow bolt of claim 1 further comprising:

an insert, formed with an outer diameter and an axial bore having internal threads formed to accept a tip;

a pin that extends axially away from said bore and is sized to be closely received within said lumen of said elongated shaft, positioned at the front end of the elongated shaft;

a nock formed with an outer diameter and a pin sized to be closely received within said lumen of said elongated shaft, positioned at the tail end of said elongated shaft; and a plurality of fletches attached to said outer surface of said elongated shaft adjacent to said tail end.

8. The small diameter double cutter crossbow bolt of claim 7, wherein said outer diameter of said nock and said outer diameter of said spacer is substantially equal.

9. The small diameter double cutter crossbow bolt of claim 7, wherein said outer diameter of said nock and said outer diameter of said spacer is substantially equal.

10. A small diameter double cutter crossbow bolt comprising:

a front shaft formed with a lumen and a length extending from a leading end to a trailing end;

a tail shaft formed with a lumen and a length extending from a leading end to a trailing end;

a spacer having a body with a leading end and a trailing end, a leading axial pin extending from said leading end of said body and a trading axial pin extending from said trailing end of said body, wherein said spacer is positioned between the front shaft and tail shaft; and a plurality of blades extending axially from said spacer.

11. The small diameter double cutter crossbow bolt of claim 10, wherein said body of said spacer further comprises a leading taper on said leading end of said body and a trailing taper on said trailing end of said body.

12. The small diameter double cutter crossbow bolt of claim 11, wherein said leading taper of said spacer is symmetrical to said trailing taper of said spacer.

13. The small diameter double cutter crossbow bolt of claim 12, wherein said body of said spacer further comprises a leading annular ring on the leading end of said body and a trailing annular ring on said trailing end of said body, said leading annular ring creating a leading flange, and said trailing annular ring creating a trailing flange.

14. The small diameter double cutter crossbow bolt of claim 10, wherein said plurality of blades is equally spaced apart and fixedly attached to said spacer.

15. The small diameter double cutter crossbow bolt of claim 10, wherein said plurality of blades is equally spaced apart and hingedly attached to said spacer.

16. The small diameter double cutter crossbow bolt of claim 10, wherein said plurality of blades comprises equally spaced spring-loaded blades that are extendable from a closed position to an open position.

17. The small diameter double cutter crossbow bolt of claim 10, wherein said plurality of blades comprises detachable blades, spaced equally apart, which detach from said spacer upon penetration of a target and remain connected by a short cable.

18. The small diameter double cutter crossbow bolt of claim 10, further comprising an adhesive applied between said leading axial pin and said lumen of said front shaft and between said trailing axial pin and said lumen of said tail shaft to secure said spacer to said front shaft and said tail shaft.

19. The small diameter double cutter crossbow bolt of claim 10 further comprising:

an insert, formed with an outer diameter and an axial bore having internal threads formed to accept a tip, a pin that extends axially away from said bore and is sized to be closely received within said lumen of said elongated shaft, positioned at the front end of the elongated shaft;

a nock formed with an outer diameter and a pin sized to be closely received within said lumen of said elongated shaft, positioned at the tail end of said elongated shaft; and a plurality of fletches attached to said outer surface of said elongated shaft adjacent to said tail end.

* * * * *